US009647378B1

(12) United States Patent
Mingo

(10) Patent No.: US 9,647,378 B1
(45) Date of Patent: May 9, 2017

(54) ELECTRICAL CONNECTOR

(71) Applicant: TYCO ELECTRONICS CORPORATION, Berwyn, PA (US)

(72) Inventor: Tisha Mikhaili Mingo, Trenton, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/150,484

(22) Filed: May 10, 2016

(51) Int. Cl.
*H01R 13/502* (2006.01)
*H01R 13/504* (2006.01)
*H01R 13/424* (2006.01)

(52) U.S. Cl.
CPC ..... *H01R 13/5045* (2013.01); *H01R 13/424* (2013.01)

(58) Field of Classification Search
CPC .. H01R 13/506; H01R 13/514; H01R 13/516; H01R 13/518; H01R 23/688
USPC ..... 439/701, 752
See application file for complete search history.

(56) References Cited

U.S. PATENT DOCUMENTS 5,122,077 A * 6/1992 Maejima ..... H01R 13/514 439/398
5,236,375 A * 8/1993 Kachlic ..... H01R 13/6275 439/607.13
5,320,555 A * 6/1994 Okabe ..... H01R 13/6272 439/354
5,573,430 A * 11/1996 Hatagishi ..... H01R 13/506 439/400
5,957,732 A * 9/1999 Ito ..... H01R 13/4367 439/701
5,967,842 A * 10/1999 Okabe ..... H01R 13/4362 439/596
6,050,859 A * 4/2000 Abe ..... H01R 13/506 439/701
6,176,745 B1 * 1/2001 Furutani ..... H01R 13/506 439/701
6,231,398 B1 * 5/2001 Furutani ..... H01R 13/506 439/701
6,582,256 B2 * 6/2003 Sakurai ..... H01R 13/518 439/701
6,623,309 B2 * 9/2003 Sakurai ..... H01R 13/518 439/364
6,773,309 B1 * 8/2004 Shuey ..... H01R 13/4365 439/701
6,780,063 B2 * 8/2004 Wang ..... H01R 24/64 439/676
6,827,504 B2 * 12/2004 Yang ..... G02B 6/4202 385/139

(Continued)

*Primary Examiner* — Abdullah Riyami
*Assistant Examiner* — Vladimir Imas

(57) ABSTRACT

An electrical connector is provided including a connector body having an upper housing, a lower housing and a front housing. The upper housing has terminal channels configured to receive terminals therein. The upper housing, the lower housing and the front housing are molded as a single piece with front sacrificial links connecting the upper and front housings and with rear sacrificial links connecting the upper and lower housings. The lower housing is press mated to the upper housing whereby the rear sacrificial links break as the lower housing is closed and mated to the upper housing. The front housing is press mated to the upper housing whereby the front sacrificial links break as the front housing is closed and mated to the upper housing.

20 Claims, 5 Drawing Sheets

(56) References Cited

U.S. PATENT DOCUMENTS

| | | | | |
|---|---|---|---|---|
| 7,794,267 | B2 * | 9/2010 | Daily | H01R 4/2433 439/402 |
| 7,972,172 | B2 * | 7/2011 | Huang | H01R 9/032 439/578 |
| 8,210,881 | B2 * | 7/2012 | Sasaki | H01R 13/506 439/701 |
| 9,039,458 | B2 * | 5/2015 | Tsuchiya | H01R 13/4365 439/686 |
| 9,065,230 | B2 * | 6/2015 | Milbrand, Jr. | H01R 12/724 |
| 9,147,957 | B2 * | 9/2015 | Randolph | H01R 13/424 |

* cited by examiner

ELECTRICAL CONNECTOR

BACKGROUND OF THE INVENTION

The subject matter herein relates generally to electrical connectors holding terminals.

In various applications of electrical connectors, devices are utilized to lock terminals in place and to assure that the terminals are in proper position within the electrical connector. Such electrical connectors are typically used in harsh environments, such as automotive applications, in which the electrical connectors are subject to vibration and other forces that may tend to have the terminals back out of the connectors.

Currently, certain electrical connectors are provided with housings having cavities extending therethrough for receiving terminals. The terminals are locked in the cavities by a primary latch, which may be part of the housing or part of the terminal itself. In order to mold the latches and other complicated features into the housing that secure the terminals in the terminal cavities, the housings are typically manufactured from two housings or shells that are coupled together. The molds use multiple slides and extra tooling to mold the complicated features into the housing. Furthermore, the electrical connectors typically include a secondary lock that acts as a backup locking feature should the primary lock fail. Such secondary locks are typically a separate piece. Moreover, the electrical connectors typically include a terminal position assurance device that is used to assure that the terminals are properly positioned in the cavities. Such terminal position assurance devices are typically a separate piece, but may be part of the secondary lock. Assembly requires picking up both housing pieces, the secondary lock and/or the terminal position assurance device, aligning them and mating them together. Such assembly is labor intensive and time consuming. Additionally, the parts are typically molded in separate molds, thereby increasing the manufacturing time for the housing.

A need remains for an electrical connector that includes locking features to secure terminals therein that may be manufactured and assembled in a cost effective and reliable manner.

BRIEF DESCRIPTION OF THE INVENTION

In one embodiment, an electrical connector is provided including a connector body having a front and a rear. The connector body includes an upper housing, a lower housing matable to the upper housing at the rear and a front housing matable to the upper housing at the front. The upper housing has terminal channels configured to receive terminals therein. The upper housing and front housing define a front cavity configured to receive at least a portion of a mating connector. The terminals extend from the terminal channels into the front cavity for mating with the mating connector. The upper housing, the lower housing and the front housing are molded as a single piece with front sacrificial links connecting the upper housing and the front housing and with rear sacrificial links connecting the upper housing and the lower housing. The lower housing is press mated to the upper housing whereby the rear sacrificial links break as the lower housing is moved from an open position to a closed position relative to the upper housing to mate the lower housing to the upper housing. The front housing is press mated to the upper housing whereby the front sacrificial links break as the front housing is moved from an open position to a closed position relative to the upper housing to mate the front housing to the upper housing.

In a further embodiment, an electrical connector is provided including a plurality of terminals configured to be terminated to ends of corresponding wires. The electrical connector includes an upper housing extending between a front and a rear. The upper housing has terminal channels receiving corresponding terminals therein. The upper housing has terminal latches configured to engage and lock the terminals in the terminal channels. The upper housing has a front pocket at the front configured to receive at least a portion of a mating connector. The terminals extend from the terminal channels into the front pocket for mating with the mating connector. The upper housing has front securing features near the front and rear securing features near the rear. The electrical connector includes a lower housing matable to the upper housing at the rear of the upper housing. The lower housing has rear securing features configured to engage the rear securing features of the upper housing to secure the lower housing to the upper housing. The electrical connector includes a front housing matable to the upper housing at the front of the upper housing. The front housing has front securing features configured to engage the front securing features of the upper housing to secure the front housing to the upper housing. The upper housing, the lower housing and the front housing are molded as a single piece with front sacrificial links connecting the upper housing and the front housing and with rear sacrificial links connecting the upper housing and the lower housing. The lower housing is press mated to the upper housing whereby the rear sacrificial links break as the lower housing is moved from an open position to a closed position relative to the upper housing to mate the lower housing to the upper housing. The rear securing features of the lower housing engage the rear securing features of the upper housing in the closed position. The front housing is press mated to the upper housing whereby the front sacrificial links break as the front housing is moved from an open position to a closed position relative to the upper housing to mate the front housing to the upper housing. The front securing features of the front housing engage the front securing features of the upper housing in the closed position.

DETAILED DESCRIPTION OF THE INVENTION

Figure 1:
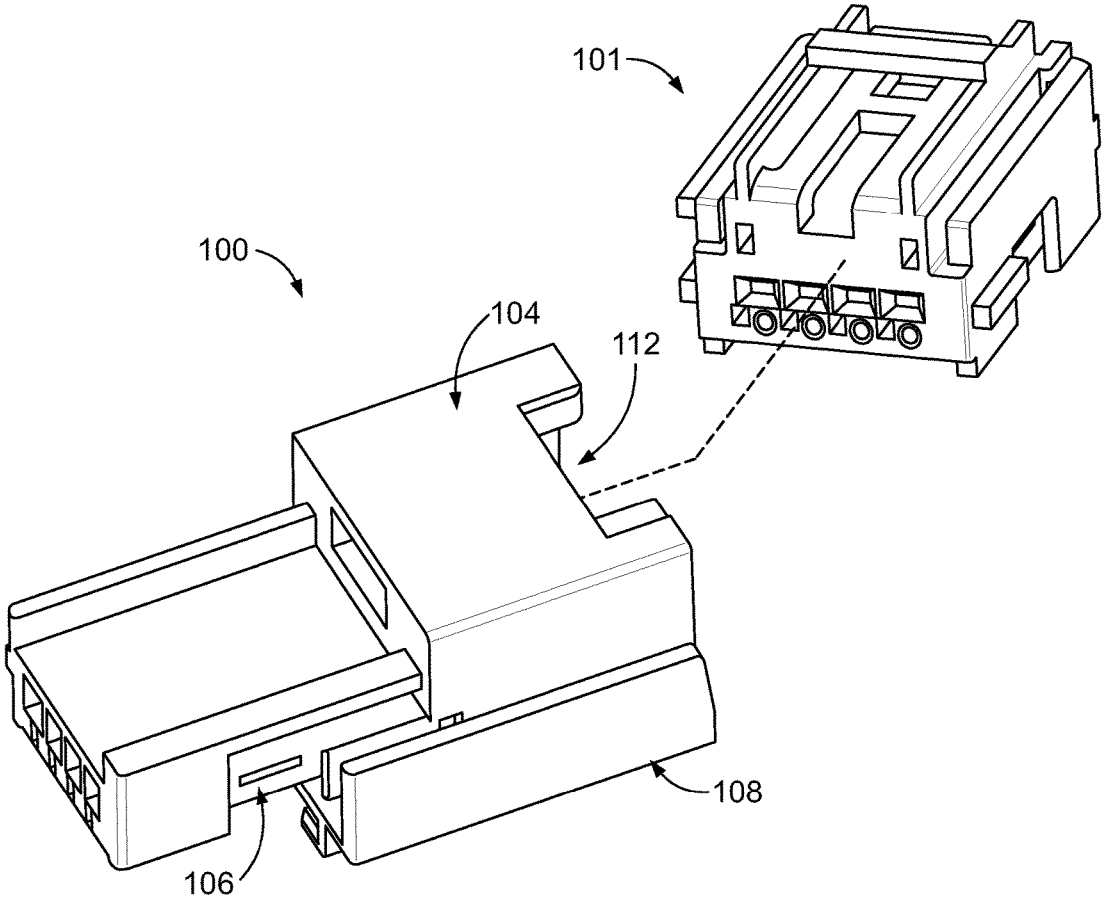
FIG. 1 is a front perspective view of an electrical connector formed in accordance with an exemplary embodiment poised for mating with a mating connector.

FIG. 1 is a front perspective view of an electrical connector 100 formed in accordance with an exemplary embodiment shown poised for mating with a mating connector 101. The electrical connector 100 includes a connector body 102 having an upper housing 104, a lower housing 106 matable to the upper housing 104, and a front housing 108 matable to the upper housing 104. The upper housing 104, lower housing 106 and front housing 108 define the connector body 102 of the electrical connector 100. The electrical connector 100 may be used in an application, such as in an automotive vehicle system, that involves the interconnection of electrical or fiber optic conductors within the system. The electrical connector 100 represents a robust, low cost, compact design. Furthermore, the configuration and arrangement of the electrical connector 100 enables use of simplified design and manufacturing processes, increasing turnover and lowering cost without adversely impacting quality and reliability.

The connector body 102 is configured to hold a plurality of terminals 110 that are configured to be mated with corresponding mating contacts of the mating connector 101. The connector body 102 includes a front cavity 112 (also shown in FIG. 2), defined by the upper housing 104 and the front housing 108. The front cavity 112 receives at least a portion of the mating connector 101. The terminals 110 extend into the front cavity 112 and are configured to be mated with corresponding mating terminals of the mating connector 101. For example, the terminals 110 may be pin terminals that are configured to be received in socket terminals of the mating connector 101. Other types of terminals may be used in alternative embodiments.

Optionally, the connector body 102 and/or the mating connector 101 may include a latch or other securing feature used to secure the electrical connector 100 to the mating connector 101. The connector body 102 may include alignment features that are used to align the electrical connector 100 with respect to the mating connector 101 during mating of the electrical connector 100 to the mating connector 101. Optionally, the alignment features may constitute keying features, wherein the electrical connector 100 may be mated with the mating connector 101 in a single orientation, defined by the alignment features. For example, the alignment features may be rails, ribs, slots, grooves, or other types of alignment features. The number and positions of the alignment features may define keyed mating with the mating connector 101.

Figure 2:
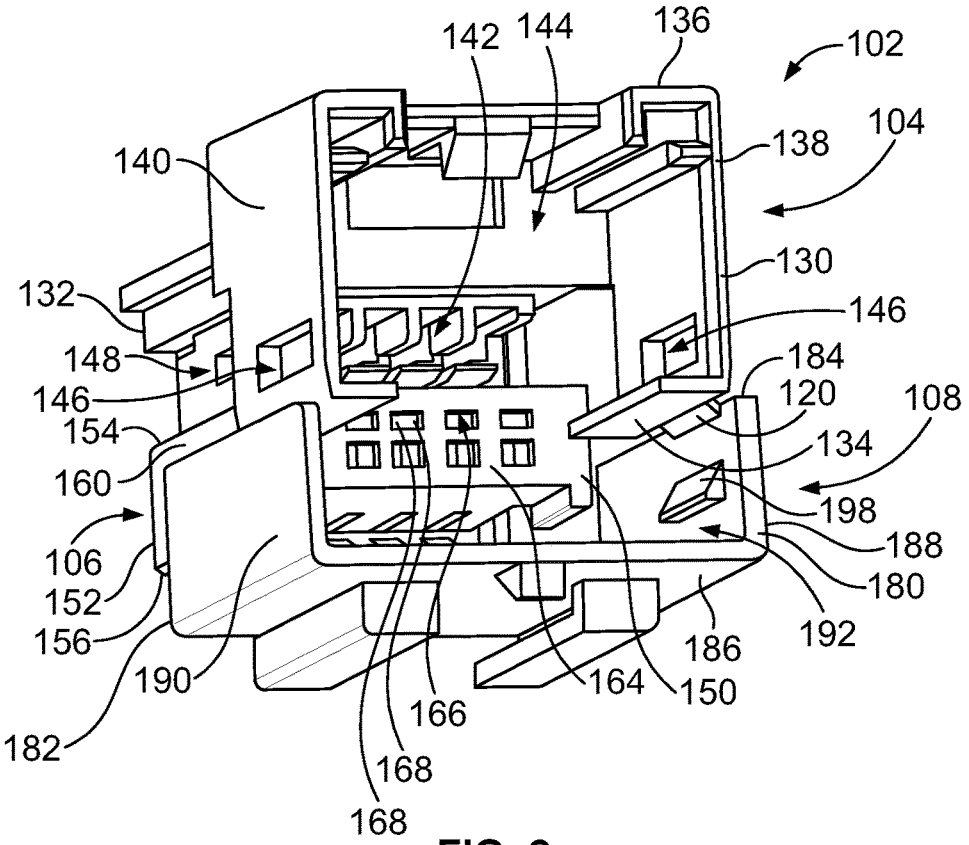
FIG. 2 is a front perspective view of a connector body of the electrical connector in an open state showing an upper housing, a lower housing and a front housing of the connector body.

In an exemplary embodiment, the upper housing 104, the lower housing 106 and the front housing 108 are molded as a single piece. The connector body 102 is molded with the lower housing 106 and the front housing 108 in an open position (FIG. 2). At some time after molding, such as prior to shipping, the lower housing 106 and the front housing 108 are pressed or press mated to closed positions (FIG. 1). For example, portions of the connector body 102 that hold the housing pieces together are broken during the press mating process. Such press mating is a simple assembly process and the housing pieces are initially held in proper position for linear press mating in a linear loading direction. Having the upper housing 104, the lower housing 106 and the front housing 108 co-molded at the same time using the same mold allows a greater volume of housings 102 to be manufactured. Having the upper housing 104, the lower housing 106 and the front housing 108 molded as distinct pieces (which are held together by sacrificial links) allows molding various features into the distinct pieces using a simple mold (for example, allowing a greater number of straight pull dies, as opposed to multiple slide dies) and less expensive tooling as compared to conventional molds that use multiple slides and expensive tooling.

Figure 3:
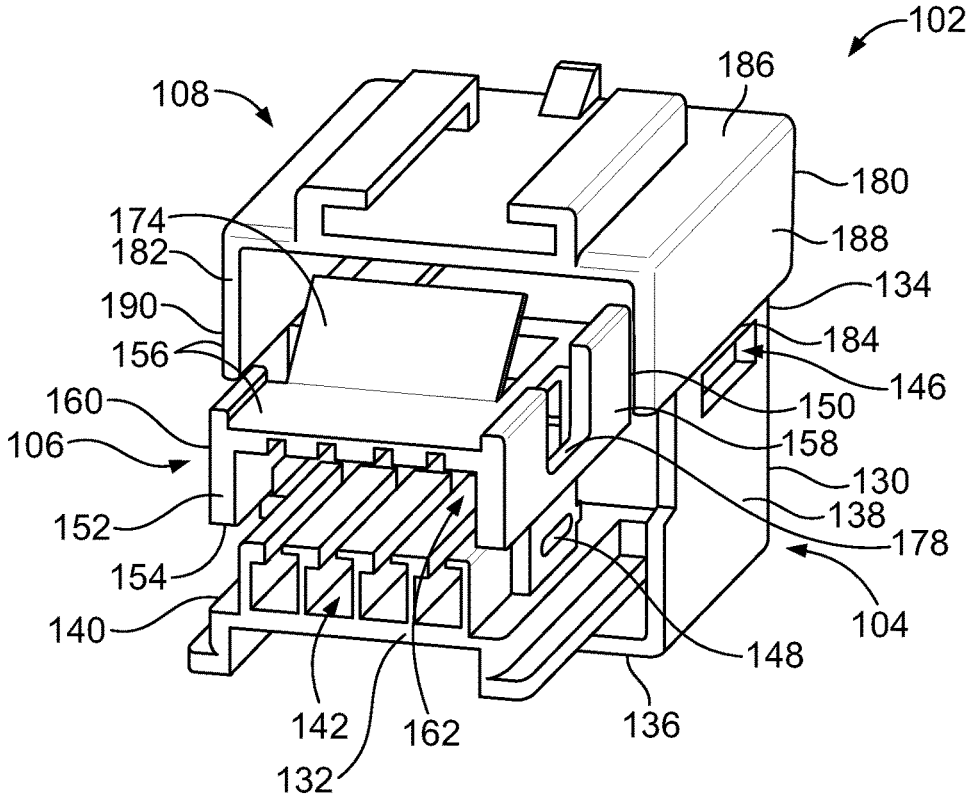
FIG. 3 is a rear, bottom perspective view of the connector body in an open state.
Figure 4:
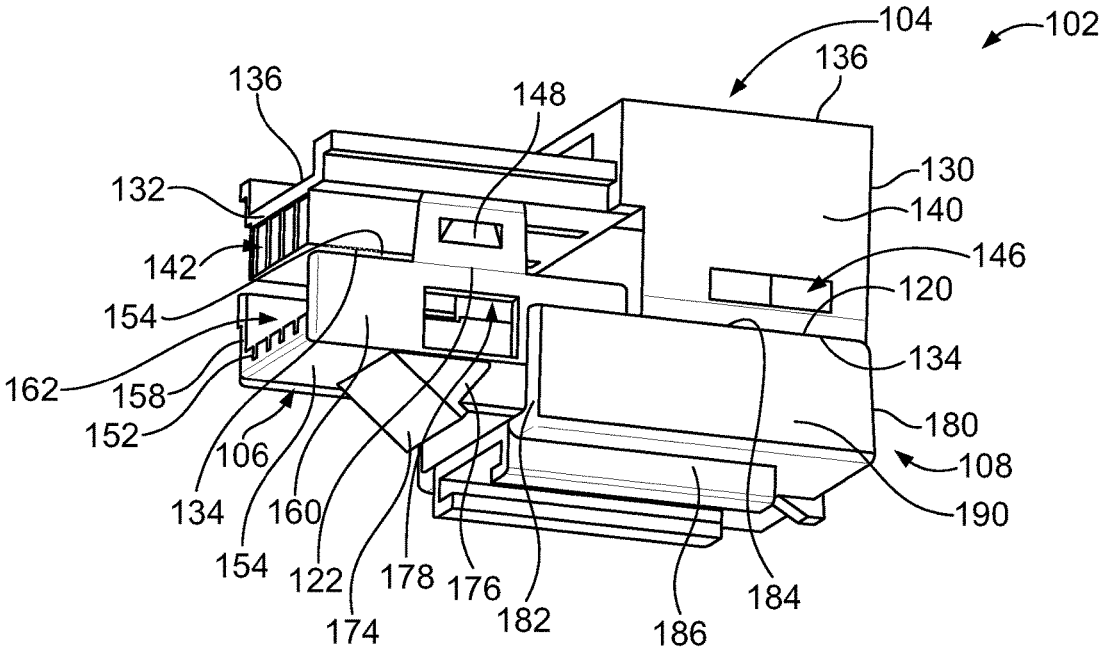
FIG. 4 is a side perspective view of the connector body in an open state.
Figure 5:
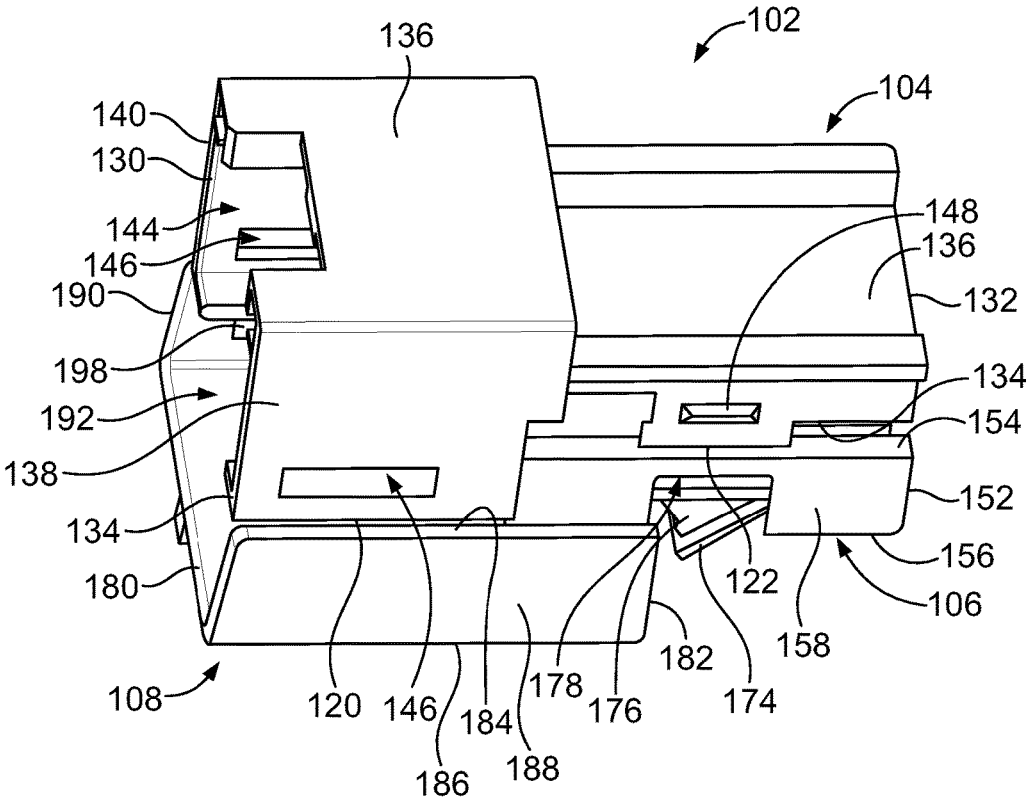
FIG. 5 is a side perspective view of the connector body in an open state.

FIG. 2 is a front perspective view of the connector body 102 in an open state showing the lower housing 106 and the front housing 108 in open positions relative to the upper housing 104. FIG. 3 is a rear, bottom perspective view of the connector body 102 in an open state. FIG. 4 is a side perspective view of the connector body 102 in an open state. FIG. 5 is another side perspective view of the connector body 102 in an open state. In an exemplary embodiment, when the connector body 102 is manufactured, the upper housing 104, the lower housing 106 and the front housing 108 are molded as a single piece with bridges or sacrificial links connecting the upper housing 104 and the lower housing 106 and with bridges or sacrificial links connecting the upper housing 104 and the front housing 108.

In an exemplary embodiment, the connector body 102 includes front sacrificial links 120 between the upper housing 104 and the front housing 108 and the connector body 102 includes rear sacrificial links 122 between the upper housing 104 and the lower housing 106. The sacrificial links 120, 122 may be formed by gaps or spaces in the dies or molds that are filled during the molding operation. For example, the mold material (e.g., plastic) may flow from the upper housing 104 into the lower housing 106 through the gaps between the upper housing mold and the lower housing mold and/or may flow from the lower housing mold into the upper housing mold. Additionally, the mold material (e.g., plastic) may flow from the upper housing 104 into the front housing 108 through the gaps between the upper housing mold and the front housing mold and/or may flow from the front housing mold into the upper housing mold. The sacrificial links 120, 122 remain behind after molding. The sacrificial links 120, 122 may be or include flashing that occurs during the molding operation.

The sacrificial links 120, 122 may be sized (e.g. have a thickness) and positioned to be breakable to separate the upper housing 104 from the lower housing 106 and from the front housing 108 during assembly of the connector body 102. At some time after molding, the sacrificial links 120, 122 are broken to separate the upper housing 104 from the front housing 108 and from the lower housing 106. In an exemplary embodiment, the connector body 102 is manufactured in such a way that the front housing 108 is aligned for mating with the upper housing 104, whereby the front housing 108 may be pressed straight onto the upper housing 104 in a mating or loading direction, such as in the direction of arrow A. Similarly, the lower housing 106 is aligned for mating with the upper housing 104, whereby the lower housing 106 may be pressed straight into the upper housing 104 in a mating or loading direction, such as in the direction of arrow B.

The sacrificial links 120, 122 are broken during press mating of the front housing 108 and the lower housing 106 with the upper housing 104. The sacrificial links 120, 122 may be broken by applying pressure to the front housing 108, the lower housing 106 and/or the upper housing 104. In an alternative embodiment, after manufacture of the connector body 102, the pieces of housings 104, 106, 108 may be separated from one another by breaking the sacrificial links 120, 122 and putting the pieces of housings 104, 106, 108 in separate bins for assembly at a later time. Having the upper housing 104 co-molded at the same time as the front housing 108 and the lower housing 106 using the same mold allows a greater volume of housings 102 to be manufactured.

The upper housing 104 is manufactured from a dielectric material. The upper housing 104 includes a front 130, a rear 132, an inner end 134, an outer end 136 and opposite sides 138, 140. The upper housing 104 has a plurality of terminal channels 142 extending between the front 130 and the rear 132. The terminal channels 142 are configured to receive corresponding terminals 110 (shown in FIG. 1) therein. The upper housing 104 has terminal latches 206 (shown in FIG. 8) extending into the terminal channels 142. The terminal latches 206 are configured to engage the corresponding terminals 110 to secure the terminals 110 in the terminal channels 142. The terminal latches 206 are deflectable beams extending into the terminal channels 142. The terminal latches 206 function may be as a primary lock for locking the terminals in the terminal channels 142.

The upper housing 104 includes a front pocket 144 at the front between the sides 138, 140. The front pocket 144 may define a portion of the front cavity 112 (shown in FIG. 1) of the connector body 102. The terminals 110 may extend into the front pocket 144.

The upper housing 104 includes front securing features 146 that are configured to engage the front housing 108 to securely couple the upper housing 104 to the front housing 108. In an exemplary embodiment, the front securing features 146 constitute pockets or windows in the sides 138, 140 defined by a ledge used to secure a corresponding catch therein. Optionally, the front securing features 146 may be aligned with the front sacrificial links 120.

The upper housing 104 includes rear securing features 148 that are configured to engage the lower housing 106 to securely couple the upper housing 104 to the lower housing 106. In an exemplary embodiment, the rear securing features 148 constitute catches extending outward from the sides 138, 140. Optionally, the rear securing features 148 may be aligned with the rear sacrificial links 122.

The lower housing 106 is manufactured from a dielectric material. The lower housing 106 includes a front 150, a rear 152, an inner end 154, an outer end 156 and opposite sides 158, 160. The lower housing 106 includes a rear pocket 162 between the sides 158, 160. The rear pocket 162 may receive at least a portion of the upper housing 104. For example, the sides 158, 160 may be wider than the sides 138, 140 such that the rear 132 of the upper housing 104 is received in the rear pocket 162.

The lower housing 106 includes a front wall 164 having a plurality of openings 166. The openings 166 are defined by guide walls 168. The front wall 164 is configured to be positioned forward of the terminal channels 142. The openings 166 are configured to be aligned with corresponding terminal channels 142 when the lower housing 106 is in the closed position such that the openings 166 receive the terminals 110. The guide walls 168 guide or engage the terminals 110 to restrict movement of the terminals 110 in mutually perpendicular directions. For example, the guide walls 168 may prevent up/down movements and may prevent side/side movements. The openings 166 may be slightly oversized to allow some movement, within a predetermined tolerance, of the terminals 110 but otherwise ensures that the terminals 110 are properly positioned in the front cavity 112 for mating with the mating connector 101 (shown in FIG. 1).

In an exemplary embodiment, the lower housing 106 includes a secondary locking wing 174. The secondary locking wing 174 is integrally formed with the lower housing 106. The secondary locking wing 174 is movable from an unlocked position to a locked position. For example, the secondary locking wing 174 may be rotated about a hinge between the unlocked and locked positions. In the unlocked position, the terminals 110 are allowed to be inserted into, and removed from, the terminal channels 142. In the locked position, the secondary locking wing 174 locks the terminals 110 from being removed from the terminal channels 142. Optionally, the secondary locking wing 174 may be used as a terminal position assurance device, assuring that the terminals 110 are fully loaded into the terminal channels 142 during assembly. For example, when one of the terminals 110 is not fully loaded, the secondary locking wing 174 may not be moved to the fully closed position, giving a visual indication that such terminal 110 is not fully loaded into the corresponding terminal channel 142.

The secondary locking wing 174 includes at least one locking tab 176 configured to be received in the corresponding terminal channels 142. The secondary locking tab(s) 176 engage corresponding terminals 110 and prevent the terminals 110 from backing out of the terminal channels 142. In an exemplary embodiment, the secondary locking tab 176 is a single tab extending into all of the terminal channels 142. Alternatively, the secondary locking tabs 176 are discrete locking tabs 176 that extend into individual terminal channels 142.

The lower housing 106 includes rear securing features 178 that are configured to engage the upper housing 104 to securely couple the upper housing 104 to the lower housing 106. In an exemplary embodiment, the rear securing features 178 constitute pockets or windows in the sides 158, 160 that receive the rear securing features 148 of the upper housing 104. The rear securing features 178 may include a ledge used to secure a corresponding catch of the rear securing features 148 of the upper housing 104. Optionally, the rear securing features 178 may be aligned with the rear sacrificial links 122. The rear securing features 178 may have other shapes or configurations in alternative embodiments. The rear securing features 178 may be located elsewhere in alternative embodiments.

The inner ends 134, 154 face one another. During assembly, the inner end 134 of the upper housing 104 is pressed into the rear pocket 162 of the lower housing 106 and/or the sides 158, 160 of the lower housing 106 are pressed onto the upper housing 104. Optionally, when manufactured as a single piece, the inner ends 134, 154 are substantially coplanar with one another with the inner ends 154 being positioned outside of the inner ends 134. The rear sacrificial links 122 connect the inner ends 134, 154 to one another. For example, during the molding process, the rear sacrificial links 122 extends between the inner ends 134, 154. The upper housing 104 is oriented such that the outer end 136 defines a top of the connector body 102. The lower housing 106 is oriented such that the outer end 156 defines a bottom of the connector body 102.

In an exemplary embodiment, the rear sacrificial links 122 extend between the sides 138, 140 of the upper housing 104 and corresponding sides 158, 160, respectively, of the lower housing 106. For example, the side 138 is connected to the side 158 by one of the rear sacrificial links 122 and the side 140 is connected to the side 160 by another of the rear sacrificial links 122. The rear sacrificial links 122 may extend any length. Optionally, the rear sacrificial links 122 may extend substantially the entire length of the sides 138, 140, 158, 160.

The front housing 108 is manufactured from a dielectric material. The front housing 108 includes a front 180, a rear 182, an inner end 184, an outer end 186 and opposite sides 188, 190. The front housing 108 includes a front pocket 192 between the sides 188, 190. The front pocket 192 may receive at least a portion of the upper housing 104. For example, the sides 188, 190 may be wider than the sides 138, 140 such that the front 130 of the upper housing 104 is received in the front pocket 192. The front pocket 192 may form part of the front cavity 112. For example, the front pocket 144 and the front pocket 192 may form the front cavity 112.

The front housing 108 includes front securing features 198 that are configured to engage the upper housing 104 to securely couple the upper housing 104 to the front housing 108. In an exemplary embodiment, the front securing features 198 constitute catches extending inward from the sides 188, 190. The catches may be received in the windows defined by the front securing features 146. Other types of securing features may be used in alternative embodiments. Optionally, the front securing features 198 may be aligned with the front sacrificial links 120. The front securing features 198 may have other shapes or configurations in alternative embodiments. The front securing features 198 may be located elsewhere in alternative embodiments.

The inner ends 134, 184 face one another. During assembly, the inner end 134 of the upper housing 104 is pressed into the front pocket 192 of the front housing 108 and/or the sides 188, 190 of the front housing 108 are pressed onto the upper housing 104. Optionally, when manufactured as a single piece, the inner ends 134, 184 are substantially coplanar with one another with the inner ends 184 being positioned outside of the inner ends 134. The front sacrificial links 120 connect the inner ends 134, 184 to one another. For example, during the molding process, the front sacrificial links 120 extends between the inner ends 134, 184. The upper housing 104 is oriented such that the outer end 136 defines a top of the connector body 102. The front housing 108 is oriented such that the outer end 186 defines a bottom of the connector body 102. Optionally, the outer end 186 of the front housing 108 may be aligned with the outer end 156 of the lower housing 106. For example, the outer end 186 may overlap the outer end 156 and be positioned outside of the outer end 156.

In an exemplary embodiment, the front sacrificial links 120 extend between the sides 138, 140 of the upper housing 104 and corresponding sides 188, 190, respectively, of the front housing 108. For example, the side 138 is connected to the side 188 by one of the front sacrificial links 120 and the side 140 is connected to the side 190 by another of the front sacrificial links 120. The front sacrificial links 120 may extend any length. Optionally, the front sacrificial links 120 may extend substantially the entire length of the sides 138, 140, 188, 190.

Figure 6:
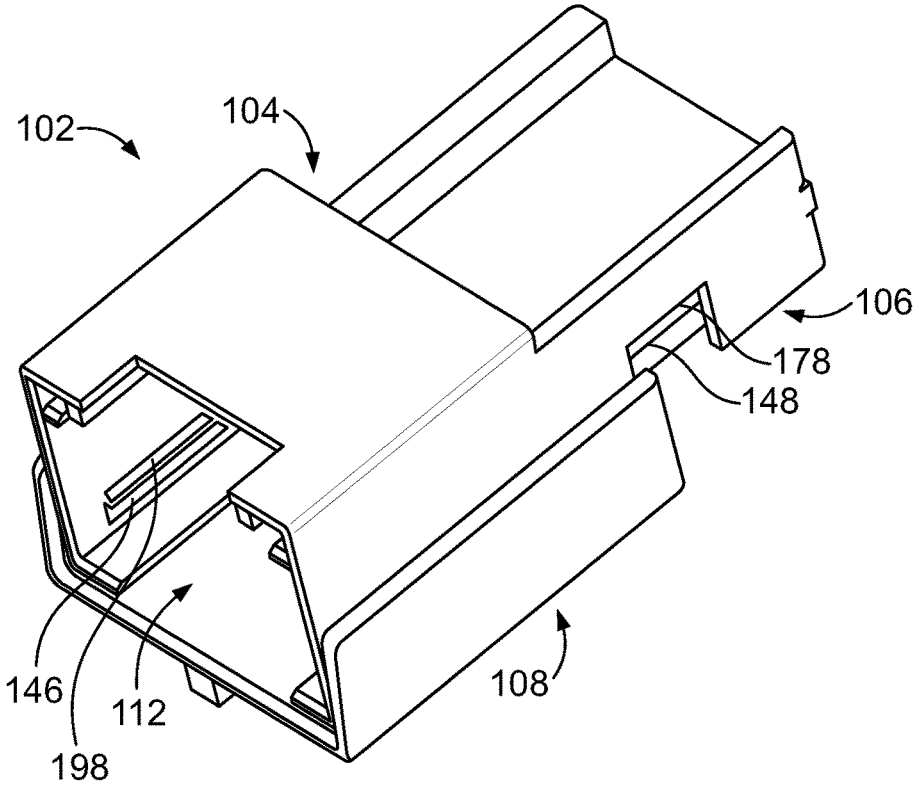
FIG. 6 is a front perspective view of the connector body in an assembled and closed state.
Figure 7:
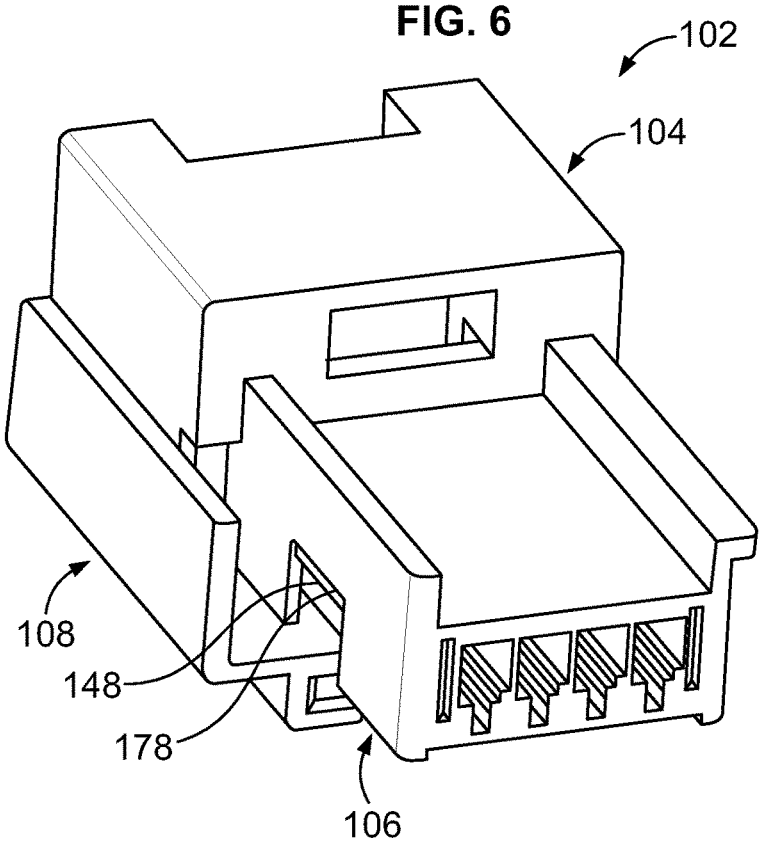
FIG. 7 is a rear perspective view of the connector body in an assembled and closed state.
Figure 8:
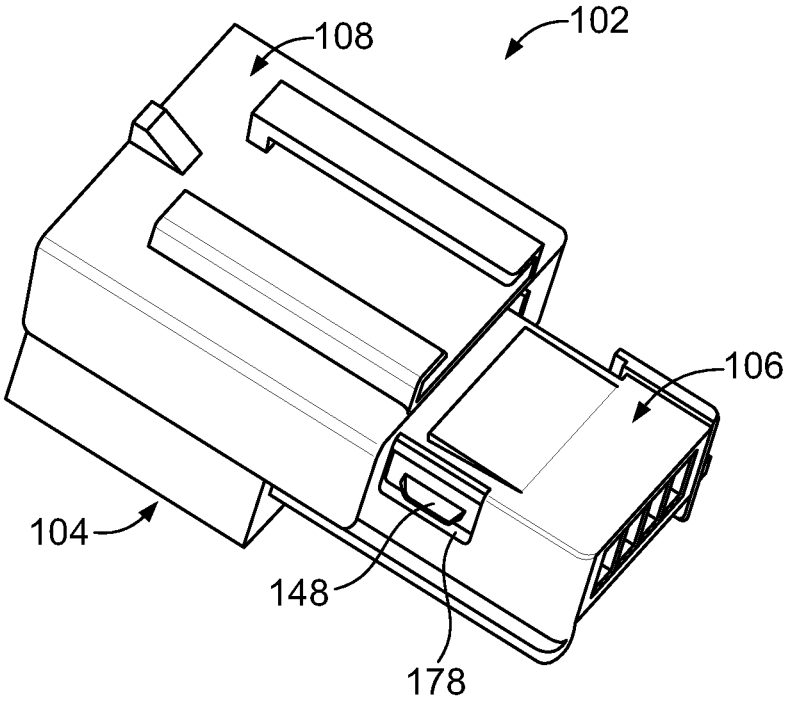
FIG. 8 is a bottom perspective view of the connector body in an assembled and closed state.

FIG. 6 is a front perspective view of the connector body 102 in an assembled and closed state. FIG. 7 is a rear perspective view of the connector body 102 in an assembled and closed state. FIG. 8 is a bottom perspective view of the connector body 102 in an assembled and closed state. As described above, the connector body 102 may be molded as a single piece with the lower housing 106 and the front housing 108 held relative to the upper housing 104 such that the lower housing 106 and front housing 108 may be assembled by simply pressing the housing pieces together, thereby breaking the sacrificial links 120, 122 (see FIGS. 2-4) between the upper housing 104 and the lower housing 106. The front cavity 112 is configured to receive the mating connector 101 (shown in FIG. 1) when in the closed position.

In an exemplary embodiment, the front housing 108 and the lower housing 106 are independently movable relative to each other. For example, the lower housing 106 may be press mated to the closed position independent from the front housing 108 being press mated to the closed position. In an exemplary embodiment, the lower housing 106 is closed prior to the front housing 108 as the front housing 108 overlaps a portion of the lower housing 106.

In the closed position, the front securing features 198 of the front housing 108 are securely engaged with the front securing features 146 of the upper housing 104. Similarly, the rear securing features 178 of the lower housing 106 are securely engaged with the rear securing features 148 of the upper housing 104.

Figure 9:
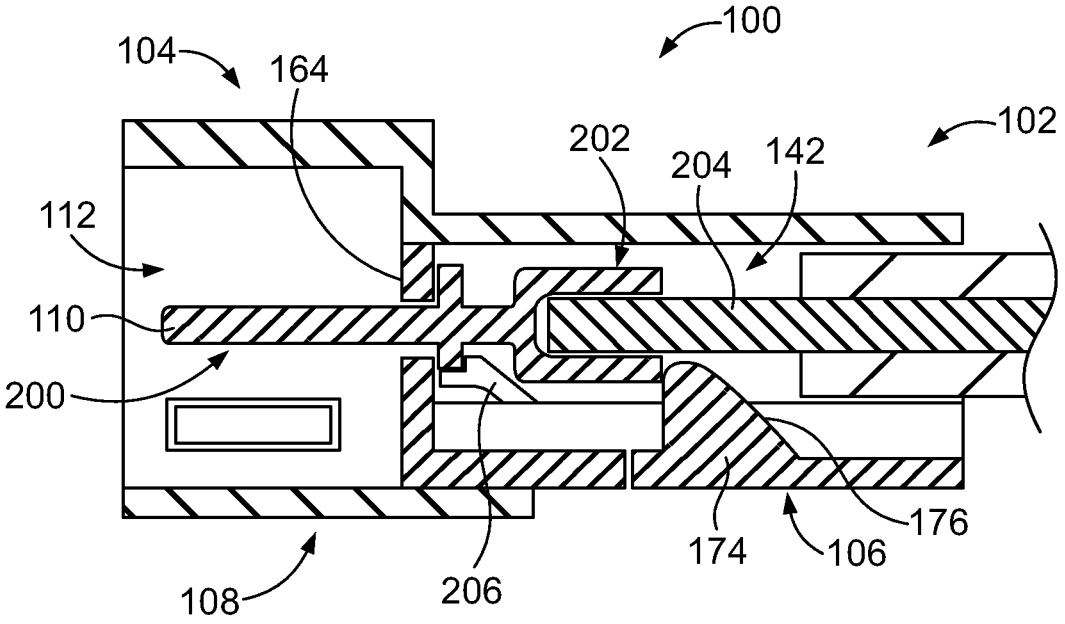
FIG. 9 is a cross-sectional view of the electrical connector showing a terminal loaded into the connector body.

FIG. 9 is a cross-sectional view of the electrical connector 100 showing a terminal 110 loaded into the connector body 102. During assembly of the connector body 102, the front housing 108 and the lower housing 106 are press mated onto the upper housing 104. The terminals 110 are loaded into the connector body 102 through the wire end or rear of the connector body 102.

The terminals 110 include a mating end 200 and a terminating end 202. The mating end 200 extends through the front wall 164 and into the front cavity 112. The mating end 200 is configured to be mated to a corresponding terminal of a mating connector 101 (shown in FIG. 1). In the illustrated embodiment, the mating end 200 is a pin configured to be mated with a socket of the mating connector 101; however other types of terminals may be used in alternative embodiments. The terminating end 202 is configured to be terminated to an end of a wire 204. In the illustrated embodiment, the terminal 110 is crimped to the wire 204. The terminal 110 may be terminated to the wire 204 by other means in alternative embodiments, such as by an insulation displacement connection, soldering and the like.

The terminal latch 206 extends into the terminal channel 142. The terminal latch 206 is configured to engage and lock the terminal 110 in the terminal channel 142. The terminal latch 206 may engage a flange, tab or other feature of the terminal 110 to lock the terminal 110 in the terminal channel 142. The secondary locking tab 176 of the secondary locking wing 174 extends into the terminal channel 142 to engage and lock the terminal 110 in the terminal channel 142. The secondary locking tab 176 may engage a rear, flange, tab or other feature of the terminal 110 to lock the terminal 110 in the terminal channel 142.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a connector body having a front and a rear, the connector body including an upper housing, a lower housing matable to the upper housing at the rear and a front housing matable to the upper housing at the front, the upper housing having terminal channels configured to receive terminals therein, the upper housing and front housing defining a front cavity configured to receive at least a portion of a mating connector, the terminals extending from the terminal channels into the front cavity for mating with the mating connector;

wherein the upper housing, the lower housing and the front housing are molded as a single piece with front sacrificial links connecting the upper housing and the front housing and with rear sacrificial links connecting the upper housing and the lower housing, the lower housing being press mated to the upper housing whereby the rear sacrificial links break as the lower housing is moved from an open position to a closed position relative to the upper housing to mate the lower housing to the upper housing, the front housing being press mated to the upper housing whereby the front sacrificial links break as the front housing is moved from an open position to a closed position relative to the upper housing to mate the front housing to the upper housing.

2. The electrical connector of claim 1, wherein the lower housing and the front housing are independently moveable from the open positions to the closed positions relative to the upper housing.

3. The electrical connector of claim 1, wherein upper housing and the front housing are molded with the front housing being aligned for mating with the upper housing whereby the front housing is configured to be pressed straight into the upper housing in a loading direction, the front sacrificial links being broken during loading of the front housing onto the upper housing.

4. The electrical connector of claim 1, wherein the upper housing and the lower housing are molded with the lower housing being aligned for mating with the upper housing whereby the lower housing is configured to be pressed straight onto the upper housing in a loading direction, the rear sacrificial links being broken during loading of the lower housing onto the upper housing.

5. The electrical connector of claim 1, wherein the upper housing has front securing features near the front and rear securing features near the rear, the lower housing including rear securing features aligned with and configured to engage the rear securing features of the upper housing to secure the lower housing to the upper housing, the front housing having front securing features configured to engage the front securing features of the upper housing to secure the front housing to the upper housing.

6. The electrical connector of claim 5, wherein the rear securing features are aligned with the rear sacrificial links and wherein the front securing features are aligned with the front sacrificial links.

7. The electrical connector of claim 5, wherein one of the front securing features of the upper housing or the front housing comprising a ledge, the other of the front securing features of the upper housing or the front housing comprising a catch engaging the ledge to secure the front housing to the upper housing.

8. The electrical connector of claim 1, wherein the front sacrificial links extend between an inner end of the upper housing and an inner end of the front housing, the rear securing links extend between the inner end of the upper housing and an inner end of the lower housing.

9. The electrical connector of claim 1, wherein the upper housing includes a front, a rear, an inner end, an outer end, and opposite sides, wherein the front housing includes a front, a rear, an inner end, an outer end, and opposite sides, and wherein the lower housing includes a front, a rear, an inner end, an outer end, and opposite sides, the inner ends of the front housing and lower housing face the inner end of the upper housing with the front sacrificial links extending between the inner end of the front housing and the inner end of the upper housing and with the rear sacrificial links extending between the inner end of the lower housing and the inner end of the upper housing.

10. The electrical connector of claim 9, wherein the outer end of the front housing and the outer end of the lower housing define a bottom of the connector body, the outer end of the front housing overlapping at least a portion of the outer end of the lower housing when the front housing and the lower housing are in the closed positions.

11. The electrical connector of claim 1, wherein the lower housing includes a front wall having a plurality of openings, the front wall being positioned forward of the terminal channels, the openings being aligned with corresponding terminal channels when the lower housing is in the closed position such that the openings receive the terminals, the openings being defined by guide walls configured to engage the terminals to restrict movement of the terminals in mutually perpendicular directions.

12. The electrical connector of claim 1, wherein the lower housing includes a secondary locking wing rotatable into a locked position, the secondary locking wing includes at least one secondary locking tab received in the corresponding terminals channels, the at least one secondary locking tab engaging the corresponding terminals and preventing the terminals from backing out of the terminal channels to lock the terminals in the terminal channels when in the locked position.

13. An electrical connector comprising:

a plurality of terminals configured to be terminated to ends of corresponding wires;

an upper housing extending between a front and a rear, the upper housing having terminal channels receiving corresponding terminals therein, the upper housing having terminal latches configured to engage and lock the terminals in the terminal channels, the upper housing having a front pocket at the front configured to receive at least a portion of a mating connector, the terminals extending from the terminal channels into the front pocket for mating with the mating connector, the upper housing having front securing features near the front and rear securing features near the rear;

a lower housing matable to the upper housing at the rear of the upper housing, the lower housing having rear securing features configured to engage the rear securing features of the upper housing to secure the lower housing to the upper housing; and a front housing matable to the upper housing at the front of the upper housing, the front housing having front securing features configured to engage the front securing features of the upper housing to secure the front housing to the upper housing;

wherein the upper housing, the lower housing and the front housing are molded as a single piece with front sacrificial links connecting the upper housing and the front housing and with rear sacrificial links connecting the upper housing and the lower housing, the lower housing being press mated to the upper housing whereby the rear sacrificial links break as the lower housing is moved from an open position to a closed position relative to the upper housing to mate the lower housing to the upper housing, the rear securing features of the lower housing engaging the rear securing features of the upper housing in the closed position, the front housing being press mated to the upper housing whereby the front sacrificial links break as the front housing is moved from an open position to a closed position relative to the upper housing to mate the front housing to the upper housing, the front securing features of the front housing engaging the front securing features of the upper housing in the closed position.

14. The electrical connector of claim 13, wherein the lower housing and the front housing are independently moveable from the open positions to the closed positions relative to the upper housing.

15. The electrical connector of claim 13, wherein upper housing and the front housing are molded with the front housing being aligned for mating with the upper housing whereby the front housing is configured to be pressed straight into the upper housing in a loading direction, the front sacrificial links being broken during loading of the front housing onto the upper housing.

16. The electrical connector of claim 13, wherein the upper housing and the lower housing are molded with the lower housing being aligned for mating with the upper housing whereby the lower housing is configured to be pressed straight onto the upper housing in a loading direction, the rear sacrificial links being broken during loading of the lower housing onto the upper housing.

17. The electrical connector of claim 13, wherein the rear securing features are aligned with the rear sacrificial links and wherein the front securing features are aligned with the front sacrificial links.

18. The electrical connector of claim 13, wherein the front sacrificial links extend between an inner end of the upper housing and an inner end of the front housing, the rear securing links extend between the inner end of the upper housing and an inner end of the lower housing.

19. The electrical connector of claim 13, wherein the upper housing includes a front, a rear, an inner end, an outer end, and opposite sides, wherein the front housing includes a front, a rear, an inner end, an outer end, and opposite sides, and wherein the lower housing includes a front, a rear, an inner end, an outer end, and opposite sides, the inner ends of the front housing and lower housing face the inner end of the upper housing with the front sacrificial links extending between the inner end of the front housing and the inner end of the upper housing and with the rear sacrificial links extending between the inner end of the lower housing and the inner end of the upper housing.

20. The electrical connector of claim 19, wherein the outer end of the front housing and the outer end of the lower housing define a bottom of the connector body, the outer end of the front housing overlapping at least a portion of the outer end of the lower housing when the front housing and the lower housing are in the closed positions.

* * * * *